US005655814A

United States Patent [19]

Gibbs

[11] Patent Number: 5,655,814

[45] Date of Patent: Aug. 12, 1997

[54] ADJUSTABLE CHAIR-ARMREST ASSEMBLY

[75] Inventor: Terence E. Gibbs, Grandview, N.Y.

[73] Assignee: Shin Yeh Enterprise Co., Ltd., Taipei, Taiwan

[21] Appl. No.: 612,064

[22] Filed: Mar. 7, 1996

[51] Int. Cl.[6] ..... A47C 7/54

[52] U.S. Cl. ..... 297/411.38; 297/411.37; 297/411.35; 248/118; 248/282.1

[58] Field of Search ..... 297/411.2, 411.33, 297/411.35, 411.37, 411.38; 248/118, 118.1, 282.1, 289.11

[56] References Cited

U.S. PATENT DOCUMENTS

| | | | |
|---|---|---|---|
| 5,143,422 | 9/1992 | Althofer et al. | 297/411.38 X |
| 5,407,249 | 4/1995 | Bonutti | 297/411.38 X |
| 5,415,459 | 5/1995 | Schultz | 297/411.2 X |
| 5,439,268 | 8/1995 | Dozsa-Farkas | 297/411.38 X |
| 5,536,070 | 7/1996 | Lemmen | 297/411.38 X |

*Primary Examiner*—Laurie K. Granmer

*Attorney, Agent, or Firm*—Ladas & Parry

[57] ABSTRACT

An adjustable chair-armrest assembly includes a positioning plate attached to a chair seat, and a coupling seat having two side walls with inverted V-shaped top edges, and a bottom wall rotatably mounted over the plate by a vertical pivot pin. The plate has several equidistant positioning holes which are all spaced apart from the pivot pin at a predetermined distance. A ball is provided on the bottom wall and is biased to engage a selected one of the positioning holes so as to position the coupling seat on the plate. A tilting seat is pivoted on the coupling seat in such a manner that the tilting seat can swing on the coupling seat. An armrest member has a wrist receiving element attached to a front end portion thereof and is mounted movably on the tilting seat in such a manner that the armrest member can be moved forward and rearward on the tilting seat. A spring unit is disposed on the rear portion of the assembly so as to return the titling seat to a predetermined position relative to the coupling seat after the wrist receiving element is depressed and turned downward. The wrist receiving element can be turned to the left or right so as to move the ball from the selected one of the positioning holes into another one of the positioning holes.

4 Claims, 6 Drawing Sheets

ADJUSTABLE CHAIR-ARMREST ASSEMBLY

This application is related to copending patent application Ser. No. 08/612,316 filed on Mar. 7, 1996.

BACKGROUND OF THE INVENTION

1. Field of the Invention

This invention relates to a chair armrest assembly, more particularly to an adjustable chair armrest assembly in which the orientation of the armrest member can be adjusted.

2. Description of the Related Art

Nowadays, in the art, people are more and more fastidious about convenience in use of chairs. Some conventional chair armrests can be adjusted horizontally and/or vertically on the chair seats. However, there is a need to rotate an armrest about a horizontal axis and/or a vertical axis on the chair seat, e.g. for a computer chair.

SUMMARY OF THE INVENTION

It is therefore the main object of this invention to provide an adjustable chair-armrest assembly with an armrest member which can be rotated about horizontal and vertical axes on the chair seat.

According to this invention, an adjustable chair-armrest assembly includes a positioning plate attached to a chair seat, and a coupling seat having two side walls with inverted V-shaped top edges, and a bottom wall rotatably mounted over the plate by a vertical pivot pin. The plate has several equidistant positioning holes which are all spaced apart from the pivot pin at a predetermined distance. A ball is provided on the bottom wall and is biased to engage a selected one of the positioning holes so as to position the coupling seat on the plate. A tilting seat is pivoted on the coupling seat in such a manner that the tilting seat can swing on the coupling seat. An armrest member has a wrist receiving element attached to a front end portion thereof and is mounted movably on the tilting seat in such a manner that the armrest member can be moved forward and rearward on the tilting seat. A spring unit is disposed on the rear portion of the assembly so as to return the titling seat to a predetermined position relative to the coupling seat after the wrist receiving element is depressed and turned downward. The wrist receiving element can be turned to the left or right so as to move the ball from the selected one of the positioning holes into another one of the positioning holes.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
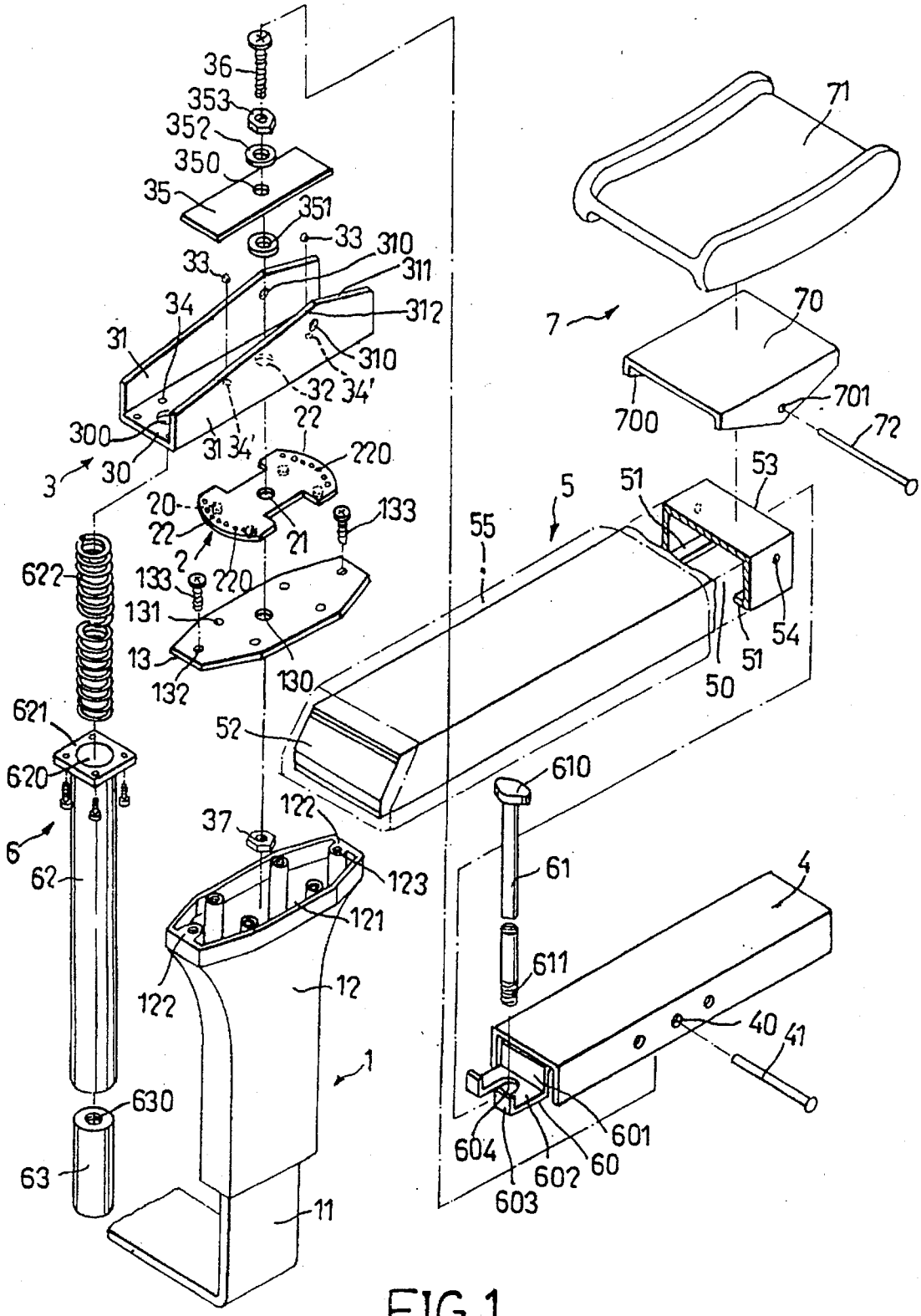
FIG. 1 is an exploded view of an adjustable chair-armrest assembly according to this invention.
Figure 2:
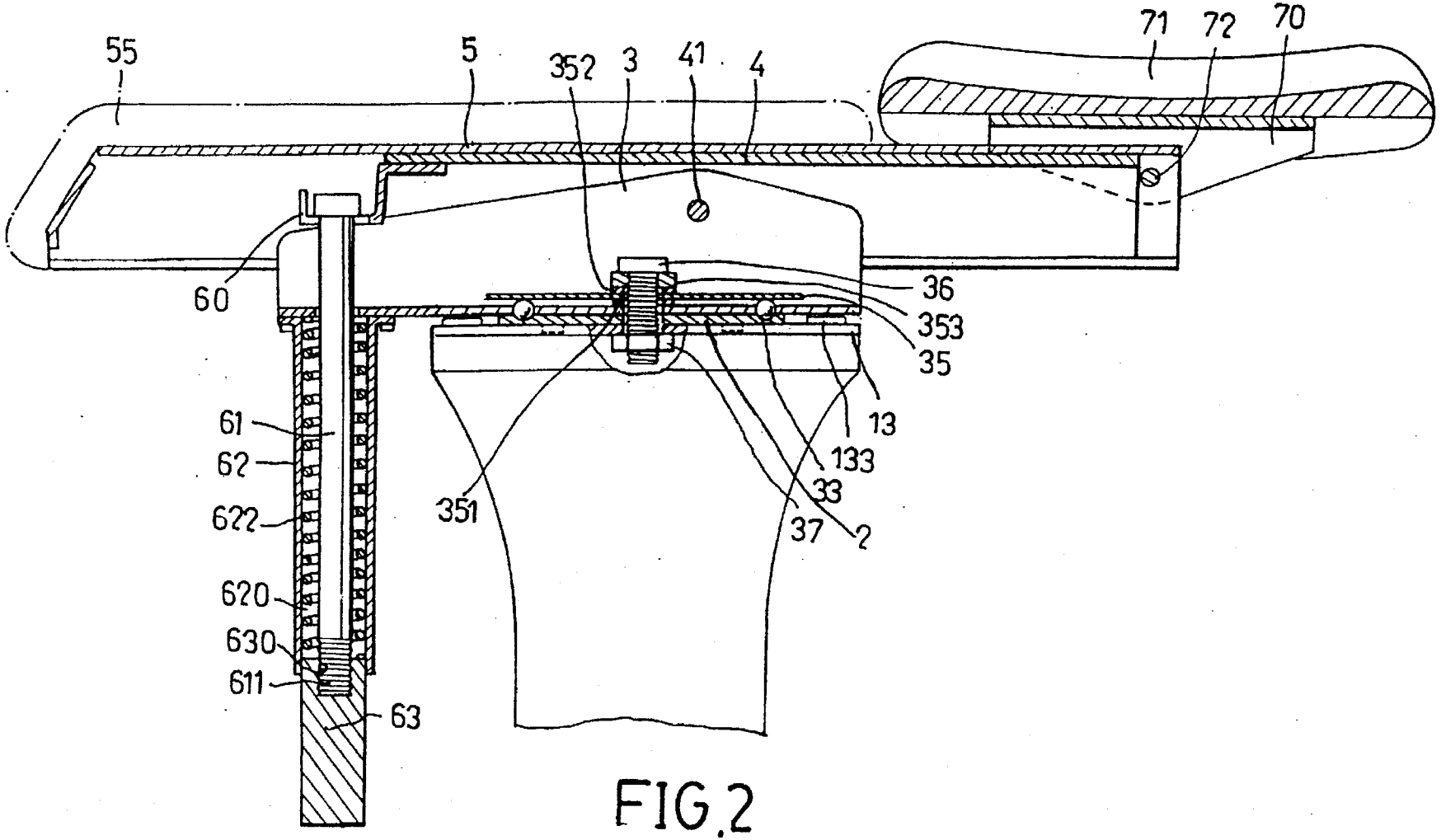
FIG. 2 is a sectional view showing the adjustable chair-armrest assembly of this invention.
Figure 3:
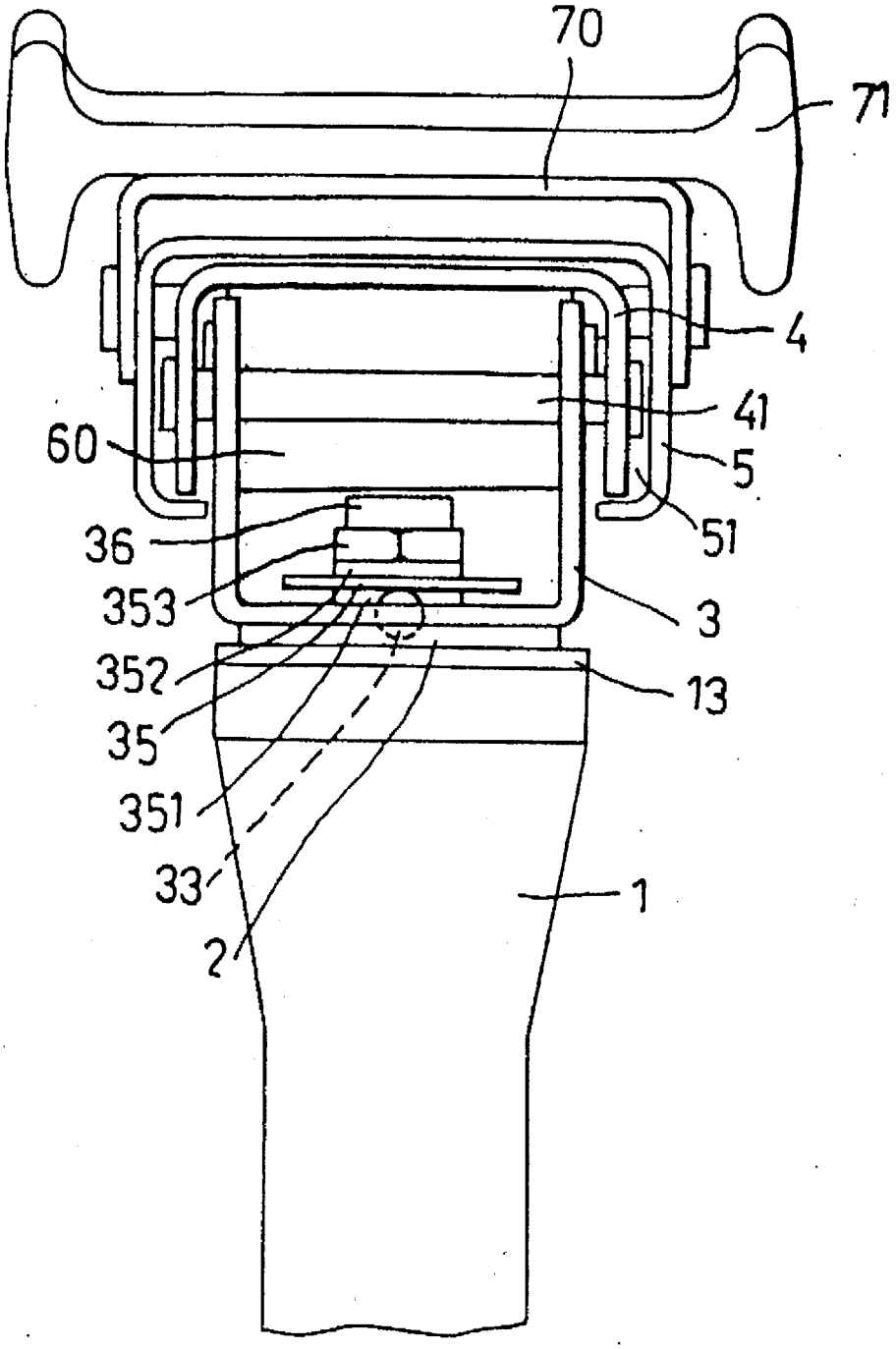
FIG. 3 is a schematic view illustrating how some elements are mounted within an armrest member of the adjustable chair-armrest assembly in accordance with this invention.

Referring to FIGS. 1, 2 and 3, an adjustable chair-armrest assembly of this invention includes an L-shaped support 1, an elongated positioning plate 2, an elongated coupling seat 3, an elongated tilting seat 4, an elongated armrest member 5, a spring unit 6 and a wrist seat 7.

The support 1 has a lower section 11 fixed on a chair seat (not shown), and an upper section 12 which includes a chamber 121, and two posts 122 that are respectively and integrally formed with two sides of the peripheral wall of the upper section 12 and that respectively have two threaded holes 123 formed in the upper end surfaces of the posts 122. A cover plate 13 has a pivot hole 130 formed therethrough, four positioning holes 131 located around the pivot hole 130, and two fastener holes 132 formed through two end portions of the cover plate 13 so that two bolts 133 extend through the fastener holes 132 to engage the threaded holes 123 of the support 1, so as to fix the cover plate 13 on the support 1.

The positioning plate 2 is generally H-shaped and includes a pivot hole 21 formed through the central portion thereof, and two side portion 22 each of which has several equidistant positioning holes 220 that are all spaced apart from the pivot hole 21 at a predetermined distance.

The coupling seat 3 is constructed in the form of a generally U-shaped plate which has an elongated rectangular bottom wall 30 and two aligned side plates 31. The bottom wall 30 has a pivot hole 32 formed therethrough the center thereof, a mounting hole 300, four threaded holes 34 located around the hole 300, and two balls 33 which are respectively confined within two ball holes 34' that are formed through the bottom wall 30 and that are located on two sides of the pivot hole 32. Each of the side walls 31 has a pivot hole 310 and an inverted V-shaped top edge which consists of a front side 311 and a rear side 312. A vertical bolt 36 extends through an upper nut 353, an upper washer 352, the pivot hole 350 of a reed spring 35, a lower washer 351, the pivot hole 32 of the coupling seat 3, the pivot hole 21 of the positioning plate 2, the pivot hole 130 of the cover plate 13 to engage a lower nut 37, in such a manner that four downwardly extending cylindrical projections 20 of the positioning plate 2 are respectively inserted into the positioning holes 131 of the cover plate 13, so as to clamp the balls 33 between the reed spring 35 and the positioning plate 2, and so as to bias the balls 33 into selected two of the positioning holes 220 of the positioning plate 2. Accordingly, the positioning plate 2 is fixed on the support 1.

The tilting seat 4 is of an inverted U-shaped cross-section and has a top wall and two side walls each of which is formed with three pivot holes 40. The top wall of the tilting seat 4 abuts on the top edges of the side walls 31 of the coupling seat 3. A horizontal pivot pin 41 extends through an aligned pair of the pivot holes 40 and the pivot holes 310 of the coupling seat 3 so that the tilting seat 4 can swing on the coupling seat 3.

The armrest member 5 has two side walls and a top wall which cooperatively define a chamber 50 under the top wall. Each of the side walls of the armrest member 5 is formed at the lower end with a horizontal rib 51, and a rear end wall 52 is integrally formed with the side walls and the top wall of the armrest member 5, so as to confine the tilting seat 4 between the side walls of the armrest member 5, in such a manner that the planar top wall of the armrest member 5 is in frictional contact with the planar top wall of the tilting seat 4, and that the armrest member 5 can move forward and rearward along the length of the tilting seat 4. The armrest member 5 further has an open end 53 near which two pin holes 54 are formed through the side walls of the armrest member 5. An armrest sleeve 55 (shown in FIG. 1 by the phantom lines) may be disposed on the armrest member 5 for placement of an arm of a user thereon.

The wrist seat 7 includes a generally inverted U-shaped coupler 70 which has two side walls 701 formed with pivot holes 701, so that a pivot pin 72 extends through the pivot holes 701 and the pivot holes 54 of the armrest member 5, thereby permitting the coupler 70 to swing on the armrest member 5. A wrist receiving element 71 is attached to the coupler 70 for placement of the wrist of the user thereon.

The spring device 6 includes a bifurcated element 60, a vertical bolt 61, a vertical tube 62 and a circular tubular retainer 63. The bifurcated element 60 has a vertical front plate section 601 extending integrally and downwardly from the top wall of the tilting seat 4, and two L-shaped arms each of which has a horizontal plate section 602 secured to the lower end of the vertical front plate section 601, and a vertical rear plate section 603 extending integrally and upwardly from the rear end of the horizontal plate section 602. The horizontal plate sections 602 define a gap 604 therebetween.

The tube 62 has an open lower end and an open upper end and defines a central bore 620. An outwardly extending flange 621 projects from the upper end of the tube 62 and is bolted to the bottom wall 30 of the coupling seat 3. A coiled tension spring 622 is placed within the central bore 620 of the tube 62.

The vertical bolt 61 has a head 610 which abuts against the top surfaces of the horizontal plate sections 602 of the bifurcated element 60 and which is located between the vertical front plate section 601 and the vertical rear plate sections 603, and a threaded stem extending through the gap 604 in the bifurcated element 60 and through the coiled tension spring 622.

The circular tubular retainer 63 has an upper end portion extending into the lower end of the tube 62, and an upper end surface formed with a threaded hole 630 within which the lower end 611 of the bolt 61 is engaged threadably, so as to compress the spring 622.

Figure 4:
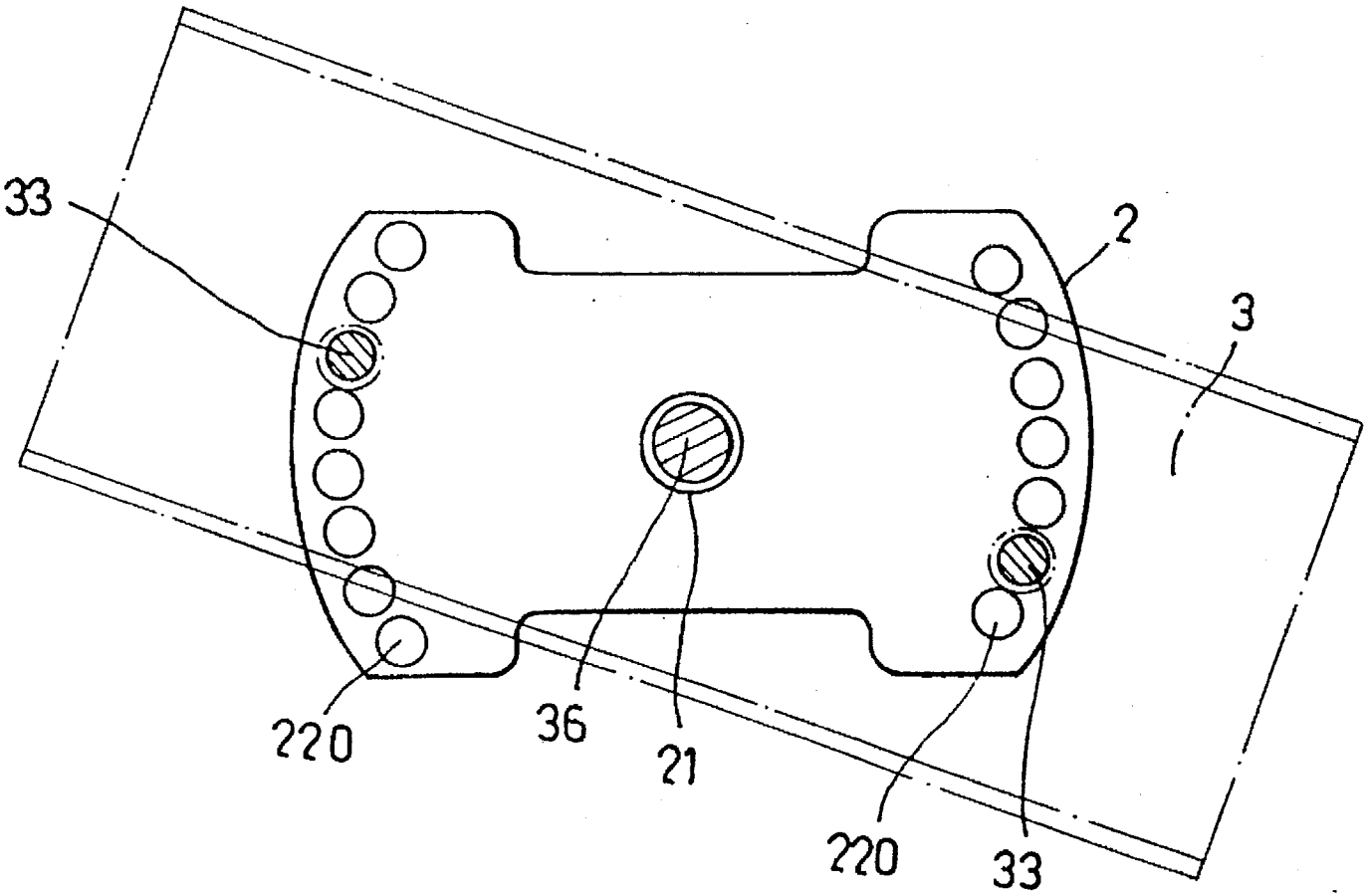
FIG. 4 is a schematic view illustrating how a coupling seat is rotated about a vertical pivot pin on a positioning plate of the adjustable chair-armrest assembly in accordance with this invention.

In use, as illustrated in FIG. 4, the balls 33 of the coupling seat 3 can be moved from two of the positioning holes 220 of the positioning plate 2 into another two of the positioning holes 220 so as to rotate the coupling seat 3 on the positioning plate 2, in order to turn the wrist receiving element 71 (see FIG. 1) to the left or right.

Figure 5:
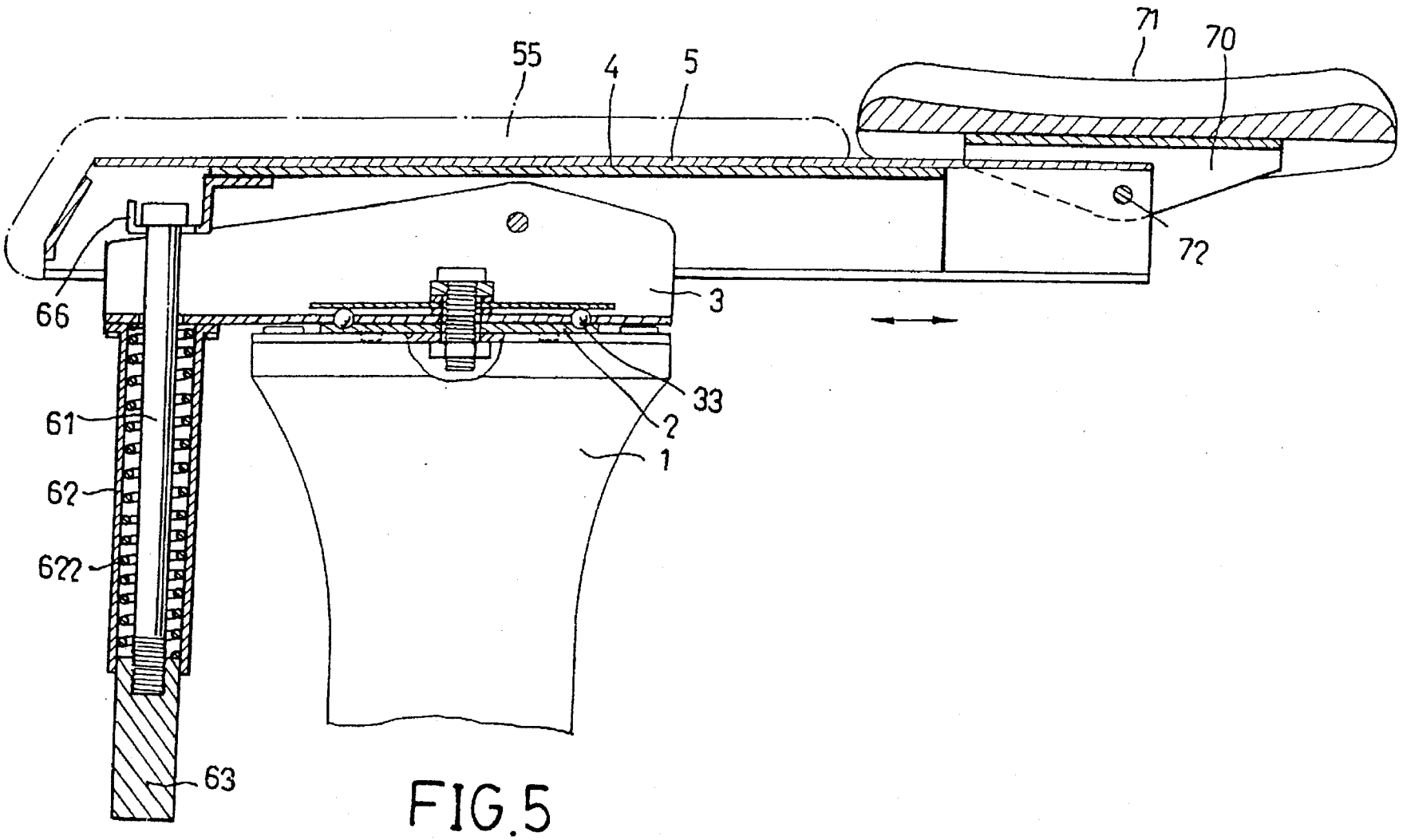
FIG. 5 is a schematic view illustrating how the armrest member is moved forward on a tilting seat of the adjustable chair-armrest assembly in accordance with this invention.

As illustrated in FIG. 5, if necessary, the armrest member 5 can be moved forward or rearward along the length of the tilting seat 4.

Figure 6:
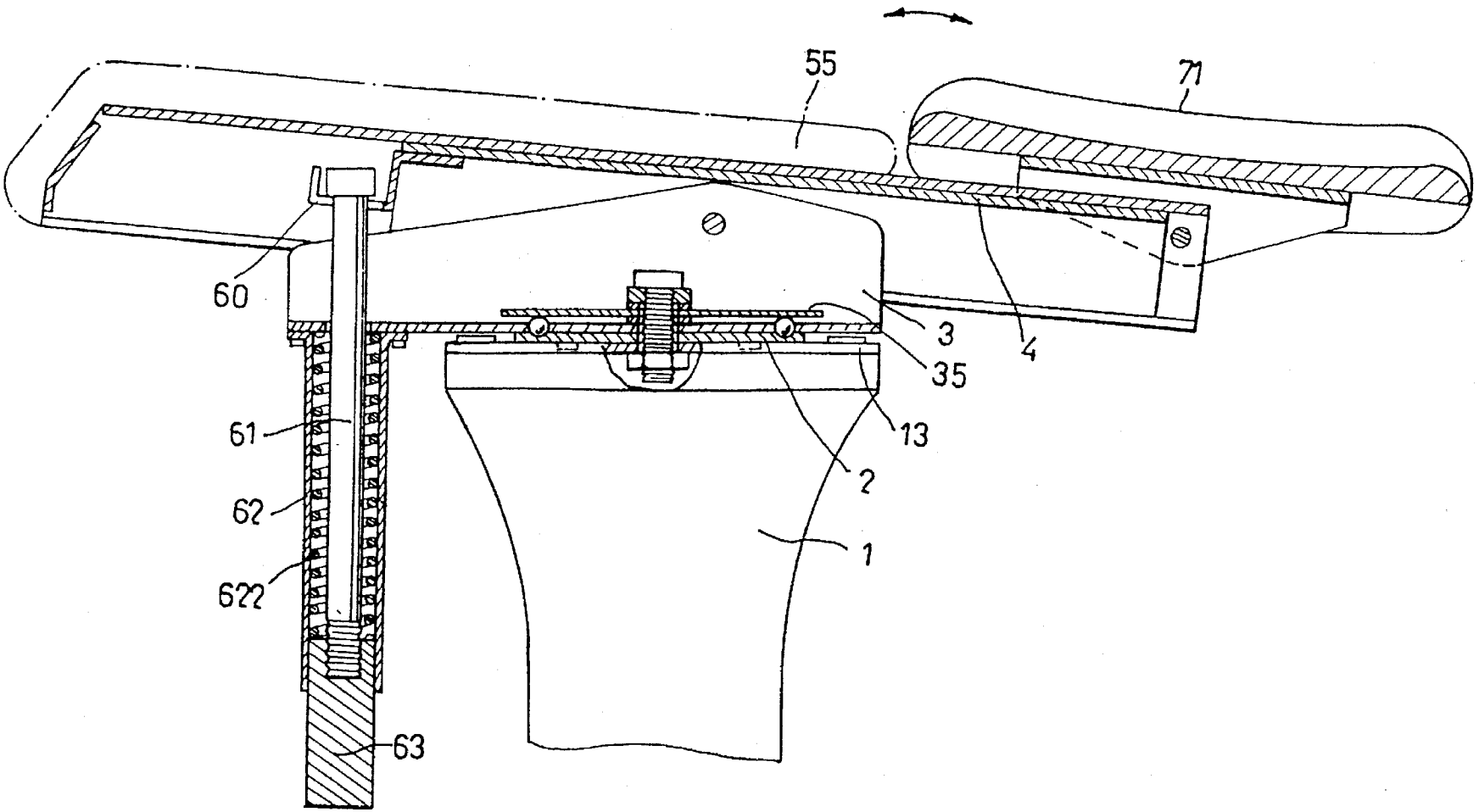
FIG. 6 is a schematic view illustrating how a wrist receiving element of the adjustable chair-armrest assembly is depressed and turned downward in accordance with this invention.

As illustrated in FIG. 6, when desired, the wrist receiving element 71 can be depressed and turned downward to descend the wrist of the user. When the downward pressure is released from the wrist receiving element 71, the spring 622 returns the wrist receiving element 71 and the tilting seat 4 to the predetermined position on the coupling seat 3.

With this invention thus explained, it is apparent that numerous modifications and variations can be made without departing from the scope and spirit of this invention. It is therefore intended that this invention be limited only as indicated in the appended claims.

I claim:

1. An adjustable chair-armrest assembly comprising:

an elongated positioning plate adapted to be attached to a chair seat and having a pivot hole formed therethrough, and several equidistant positioning holes which are formed in a top surface of said positioning plate and which are all spaced apart from said pivot hole of said positioning plate at a predetermined distance;

an elongated coupling seat having a bottom wall which includes a pivot hole formed therethrough, a vertical pivot pin extending through said pivot holes of said positioning plate and said bottom wall so that said coupling seat can rotate about said pivot pin on said positioning plate, and a ball biased to engage a selected one of said positioning holes of said positioning plate, said coupling seat being capable of being rotated relative to said positioning plate so as to move said ball from the selected one of said positioning holes into another one of said positioning holes, thereby rotating said coupling seat on said positioning plate;

an elongated tilting seat mounted pivotally on said coupling seat and rotatable about a horizontal axis, said tilting seat having a planar top wall; and an armrest member having a wrist receiving element which is attached to a front end portion thereof and which is adapted to permit placement of a wrist or a user thereon, and a planar top wall with a bottom surface which is in frictional contact with a top surface of said top wall of said tilting seat, said armrest member being movable forward and rearward on said tilting seat;

whereby, orientation of said armrest member can be adjusted by applying a force to said armrest member.

2. An adjustable armrest assembly as claimed in claim 1, wherein said coupling seat further has two aligned vertical side walls with inverted V-shaped top edges on which a bottom surface of said top wall of said tilting seat abuts, said tilting seat further having two vertical side walls with top ends which are integral with said top wall of said tilting seat in such a manner that said coupling seat is located between said side walls of said tilting seat, so that said tilting seat can swing in said coupling seat by depressing said wrist receiving element of said armrest member, said assembly further including a spring unit interconnecting a rear end portion of said coupling seat and a rear end portion of said tilting seat so as to pull the rear end portion of said tilting seat downward to a predetermined position relative to said coupling seat, whereby, in a case where said wrist receiving element is depressed by a downward pressure, as soon as the downward pressure is released, said spring unit returns said tilting seat to the predetermined position.

3. An adjustable armrest assembly as claimed in claim 2, wherein said spring unit includes:

a vertical tube connected securely to a bottom surface of said bottom wall of said coupling seat and having an open upper end and an open lower end;

a coiled tension spring placed within said tube;

a bifurcated element having a vertical front plate section extending integrally and downwardly from said top wall of said tilting seat, and two L-shaped arms each of which has a horizontal plate section secured to a lower end of said vertical front plate section, and a vertical rear plate section extending integrally and upwardly from a rear end of said horizontal plate section, said horizontal plate sections of said L-shaped arms defining a gap therebetween;

a vertical bolt having a head which abuts against top surfaces of said horizontal plate sections of said arms and which is located between said vertical front plate section and said vertical rear plate sections, and a threaded stem extending through said gap defined by said horizontal plate sections of said arms and through said coiled tension spring; and a circular tubular retainer having an upper end portion extending into the lower end of said tube, and an upper end surface formed with a threaded hole within which a lower end of said bolt is engaged threadably, so as to compress said spring.

4. An adjustable chair armrest assembly as claimed in claim 1, wherein said armrest member has a rear end wall extending integrally and downwardly from a rear end of said top wall thereof, so as to prevent forward removal of said armrest member from said tilting seat.

* * * * *